US006866553B2

(12) United States Patent
Escacena Perez

(10) Patent No.: US 6,866,553 B2
(45) Date of Patent: Mar. 15, 2005

(54) RETRACTABLE SYSTEM FOR STOWING AWAY THE PROPULSION COMPONENTS FOR A VESSEL

(76) Inventor: Javier Escacena Perez, Puerto Del Monasterio, 21-2° B 28053, Madrid (ES)

( * ) Notice: Subject to any disclaimer, the term of this patent is extended or adjusted under 35 U.S.C. 154(b) by 0 days.

(21) Appl. No.: 10/722,071

(22) Filed: Nov. 24, 2003

(65) Prior Publication Data

US 2004/0142610 A1 Jul. 22, 2004

(30) Foreign Application Priority Data

Nov. 25, 2002 (ES) ..... 200202699
Jun. 20, 2003 (ES) ..... 200301455

(51) Int. Cl.[7] ..... B63H 5/125
(52) U.S. Cl. ..... 440/63; 440/54
(58) Field of Search ..... 114/54, 63; 440/53, 440/54, 63

(56) References Cited

U.S. PATENT DOCUMENTS 2,151,004 A * 3/1939 Barclay ..... 244/50
5,152,240 A * 10/1992 Fontanille ..... 114/151

* cited by examiner

*Primary Examiner*—Ed Swinehart
(74) *Attorney, Agent, or Firm*—Ladas & Parry LLP

(57) ABSTRACT

A retractable propulsion system for s vessel has an engine (2) mounted within the hull (1; 101) with a drive shaft connected through a universal joint (6) to a propeller shaft (3; 103), supported so that it can rotate and slide in a bearing (7; 105) at a point close to the propeller (4; 104). The bearing (7; 105) is articulated at one end of an extension-retraction mechanism (8, 9; 110, 115, 116, 118) through which the propeller shaft can be placed in a first operating position outside the hull or a second retracted position in a housing (11, 12; 102, 111) in the hull with a door (13, 13'; 15). A device for actuating, guiding and locking this system has a pair of upper arms (118, 118') and a pair of lower arms (110, 110') forming an articulated parallelogram (118, 118'; 110, 110'). The device of articulated arms (118, 118'; 10, 110') is locked in the operating position when the upper arms (118, 118') are in an over-centering position once the lateral members (121, 121') have been coupled to fixing members (113, 113').

4 Claims, 10 Drawing Sheets

RETRACTABLE SYSTEM FOR STOWING AWAY THE PROPULSION COMPONENTS FOR A VESSEL

SCOPE OF THE INVENTION

This invention relates to a retractable system for stowing away all the components of the main propulsion system which are exterior to the hull, such as shafts, supporting frames and propellers, within the hull of a vessel. The invention likewise relates to an actuating, guidance and locking arrangement for a system of this kind designed to improve the performance of the propulsion system when in use.

BACKGROUND TO THE INVENTION

The problem which arises, especially in vessels with mixed mechanical/sail propulsion, of reducing the hydrodynamic resistance of the components forming part of the mechanical propulsion which project from the submerged part of the hull, such as shafts, supporting frames, propellers, turbines or any other appendages necessary for such propulsion (excluding those used in manoeuvering), when not in use, mainly when under sail, has been known for some time.

Up to now various solutions have been developed for achieving a maximum reduction in the hydrodynamic resistance of such propulsive components while under sail; among others there is fairing of the shafts and supporting frames, as well as the use of variable pitch propellers, using feathering or folding blades. As mentioned, expensive solutions of this type seek to achieve a maximum reduction in the major penalty imposed upon the performance of a vessel of the class mentioned by the existence of appendages which when not in use have no other function than to increase resistance to sailing. However, the results achieved with these leave much to be desired.

One of these known approaches comprises variable pitch propellers which are generally equipped with internal gears which are also capable of orientating the blades in the direction of the vessel's travel when the engine is stopped (feathering).

Another arrangement which is currently in use is that of propellers with folding blades which generally comprise at least two hinged blades connected together by gears which unfold after a specific number of revolutions and which fold up when the vessel is sailing without the engine in operation (through the thrust effect of the water acting upon them), in order to reduce the braking effect otherwise exerted by the said blades.

The result of the two arrangements considered is firstly that the appendages giving rise to the hydrodynamic resistance do not wholly disappear and secondly that all the propellers described have a poorer performance when in use than a propeller having a fixed pitch and diameter, with the result that in the case of vessels incorporating this type of arrangement the power of the engine has to be limited so as not to excessively increase the resistance caused by fitting a propeller of larger dimensions and, as a consequence, when sailing under motor propulsion this type of vessel cannot achieve the maximum speed which it could develop in view of its length.

Furthermore, and in the case of sailing vessels, the provision of auxiliary engine equipment provided with a fixed pitch propeller makes it necessary to install a braking system to prevent the shaft from rotating if it is desired that the mechanism should not be compelled to suffer vibration and wear if it rotates freely.

Likewise, continued exposure of the propulsion components to the marine environment gives rise to sticking and organic encrustation which affect their preservation and performance, especially during periods of prolonged inactivity.

Various documents comprising the state of the art are known in the patent literature, and in the applicant's opinion the most pertinent are the following:

U.S. Pat. No. 6,056,610 describes a transverse or longitudinal propulsion system associated with means to extend it from a well present in the hull of a vessel into an operating condition and retract it within the said well when it is not in use. Movement between these two extended and retracted positions respectively is brought about through an operating arm located along the geometrical axis of the well and along the continuation of this within the hull.

This type of propulsion system increases manufacturing costs and appreciably complicates transmission of the drive from the motor, unless this is located in the propulsion system itself, which further increases costs and limits the power available in relation to its size, for which reason its application is restricted to auxiliary manoeuvering systems, and never the main propulsion for the vessel.

U.S. Pat. No. 4,668,197 teaches a retractable auxiliary propulsion device designed for use on small vessels and comprising an engine/propulsion system assembly mounted above the waterline in inclined guides and housed in a compartment in the stern of the vessel when not in use. This device can be lowered into its operating position, sliding downwards along the said guides, so that its propulsion member, for example a propeller, is placed in the water. The assembly in question is provided with a shape which can also perform the function of a rudder through the operation of a hydraulic piston which orientates it in one direction or another. The upward and downward movement of this engine member is brought about through a hydraulic piston and a cable.

The subject matter of this document is an economical auxiliary propulsion device of low power and which can be used for vessels of small size only.

U.S. Pat. No. 4,678,440 describes a propulsion system for vessels which makes it possible to use these in shallow waters, in that the engine and the propeller shaft constitute a rigid assembly mounted in a tilting manner above the flat of the stern in such a way that the propeller can be submerged into the water to a greater or lesser extent, or completely removed from it. Control of the tilting of this engine, shaft and propeller assembly is brought about through a lever operated by a crew member and is incorporated with the said engine-propeller shaft assembly at a point close to the former, and this lever can incorporate controls for operation of the said engine.

This type of propulsion system can only be used for vessels of very small size, for example boats of the type used by fishermen or hunters who need to move in very shallow waters such as marshes, and nowhere in the document is the possibility of applying it to vessels of appreciable length and displacement mentioned.

SUMMARY OF THE INVENTION

This invention overcomes the abovementioned problems in a simple and economic way, providing a propulsion system associated with a vessel in a novel way as a result of which the resistance generated by the propulsion members projecting from the submerged part of the hull when sailing when the system is not in use is wholly eliminated in accordance with the characterizing part of claim 1.

The object of this invention is accomplished through wholly or partly stowing away the said propulsion members in any situation (when beached, in shallow water, over-wintering, in the presence of surface obstacles, etc.) as convenient or necessary and, especially, when under sail.

The following advantages are achieved in this way:

optimization of performance when under sail, optimum utilization of the engine's power, as it is possible through incorporation of the system according to the invention to fit propellers of larger diameter and pitch without giving rise to hydrodynamic resistance when they are being pulled along when under sail.

This better utilization of the engine's performance together with the possibility of fitting engines of greater power which can make use of the said larger propellers make it possible for any vessel to achieve the maximum speed permitted by its waterline length when it is propelled by the engine.

In addition to this, when placed in their retracted position the components of the propulsion system incorporated in the invention suffer less deterioration due to the action of the marine environment during the periods while the vessel is inactive.

It completely eliminates the possibility of snagging on nets, cables and other floating objects when under sail which would otherwise make it impossible to use the engine/propulsion unit—the cause of multiple accidents and the loss of vessels.

The invention incorporates a complete revolution and a new concept, especially in the field of sports vessels, given that through its application a vessel having maximum performance under sail can easily be converted into a vessel of the motor-sail type (a sailing vessel which has a similar performance to a motor vessel when there is no wind).

In a specially preferred embodiment a propulsion system according to this invention incorporates an actuating, guide and locking device which enable it to offer wholly reliable performance and sufficient robustness in its operating position in accordance with the features included in claim 10.

These and other objects which will be obvious to those skilled in the art will become apparent from a reading of the following detailed description of preferred embodiments of this invention together with the appended drawings.

BRIEF DESCRIPTION OF THE DRAWINGS

In what follows the invention will be described with reference to the appended drawings in which currently preferred embodiments of the invention are represented purely for illustrative purposes and in which.

DETAILED DESCRIPTION OF THE PREFERRED EMBODIMENTS

Figure 1:
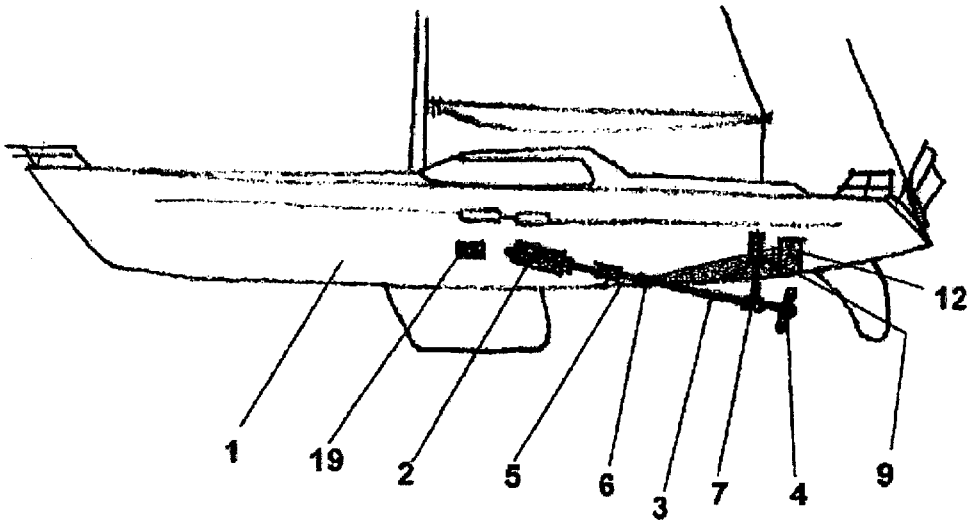
FIG. 1 is a diagram showing a sailing vessel incorporating a propulsion system according to the invention.
Figure 3:
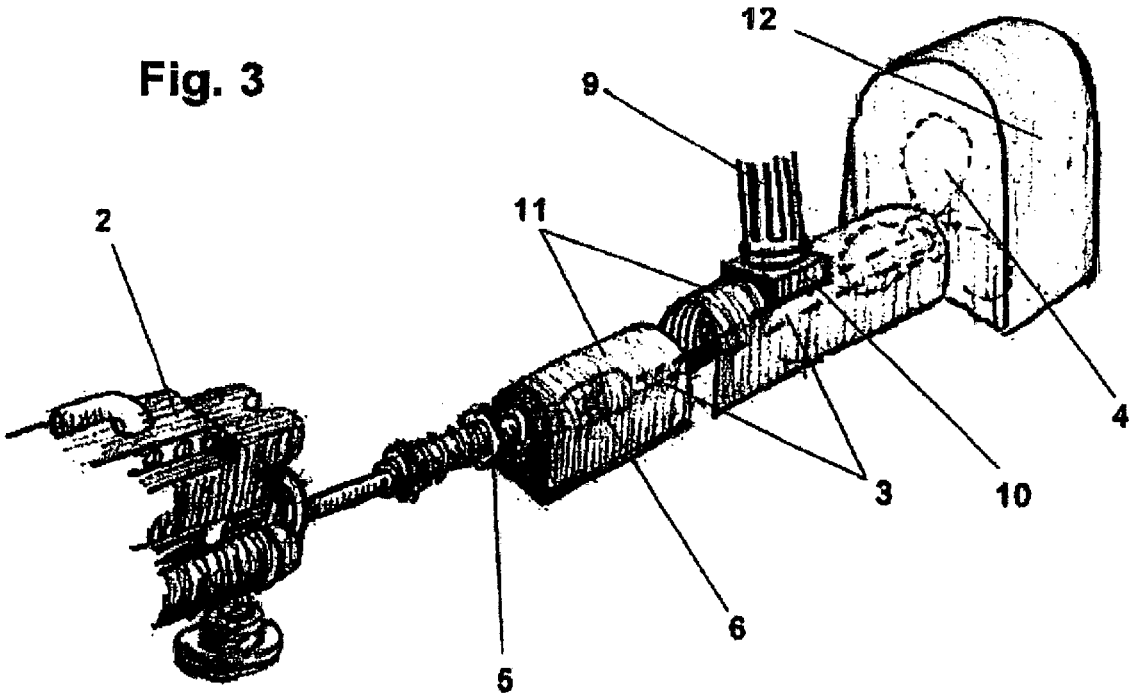
FIG. 3 shows a diagrammatical perspective view of the general spatial arrangements of the elements of the propulsion system according to the invention in a condition in which it is not in operation.
Figure 2:
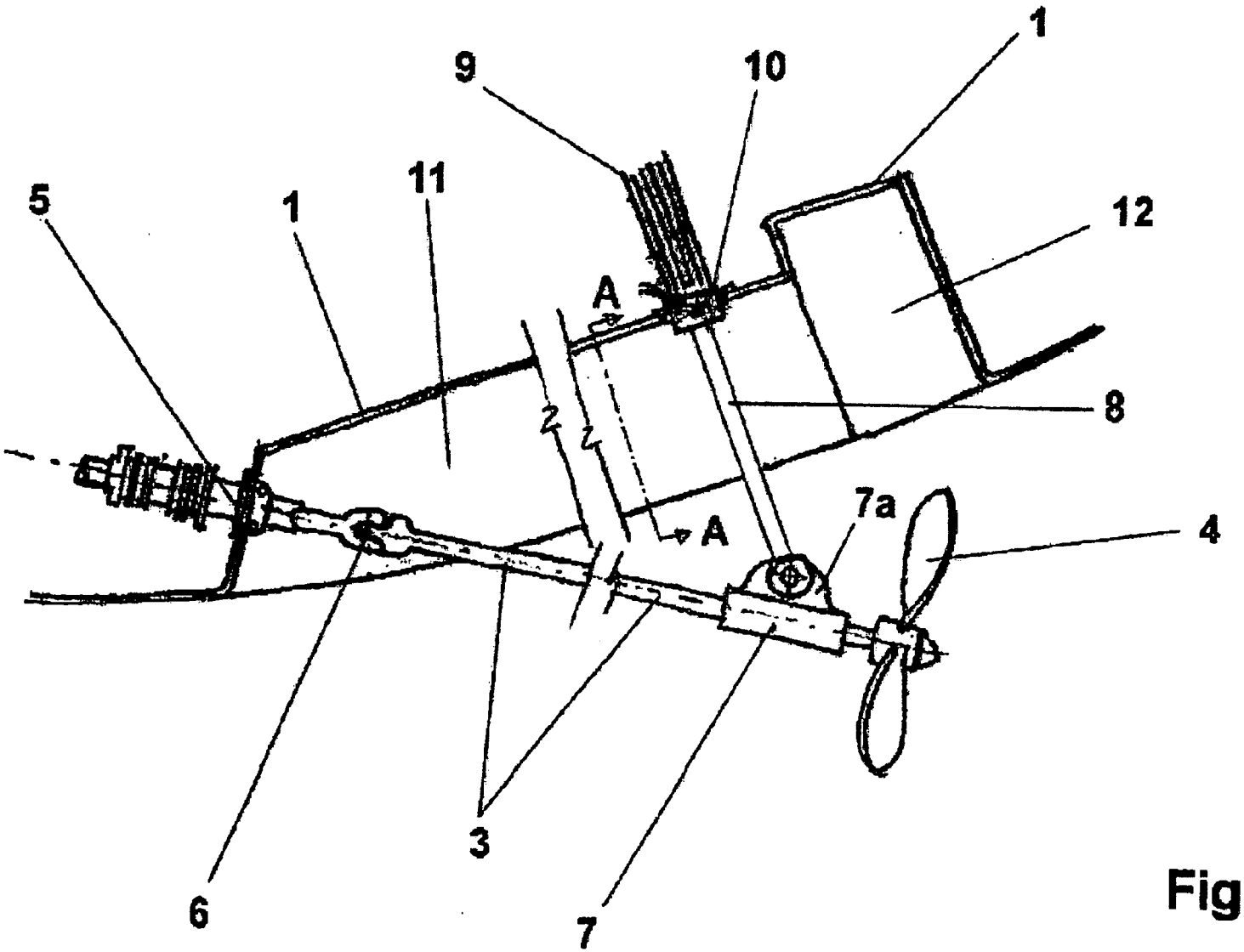
FIG. 2 is a diagrammatical view illustrating the elements comprising the system according to the invention in partial longitudinal cross-section and in greater detail.

With reference now to the drawings and in particular FIGS. 1 and 3 thereof, 1 indicates the hull of a sailing vessel provided with a propulsion system comprising an engine 2 driving a shaft 3 of a propeller 4 with a stern tube and gland 5 which allows said shaft 3 to pass beyond said hull 1 (see FIG. 2).

Shaft 3 incorporates a universal joint 6 (or alternatively a homokinetic joint may be used) and at the extremity thereof close to propeller 4 it is supported in rotation by a smooth bearing 7 through which said shaft 3 can slide longitudinally.

Smooth bearing 7 has formed within its upper part an eye lug 7*a* provided with an opening to which the end of rod 8 of an operating piston 9, for example a hydraulic piston, is hinged through a pin, piston 9 in turn being secured at 10 to the upper part of the housing 11 in the form of a tunnel formed longitudinally within hull 1 in such a way that said piston 9 can move propeller shaft 3 causing it to rise or fall with respect to hull 1 through appropriate leaktight means (not illustrated), the said shaft pivoting about universal joint 6 between an operating position (illustrated in FIG. 2) in which rod 8 is in the extended position and the system is ready to propel the vessel by engine 2, and a position in which it is out of use (see FIG. 3) in which rod 8 is retracted within piston 9, causing smooth bearing 7 to rise and as it rises to slide slightly away from propeller 4 and causing shaft 3 to tilt about joint 6 in order to house it in tunnel 11 where it is secured, propeller 4 entering an enlarged part or well 12 formed at the after end of the said tunnel 11 and adequately dimensioned to receive said propeller 4 (see FIG. 3).

This mechanism for raising and lowering propeller shaft 3 is provided with immobilizing mechanisms (not illustrated) which make it possible to secure it in either of its extreme extended or retracted positions in such a way as to prevent undesired and unforeseen movements of the latter from either of the said positions.

As may be seen, operating piston 9 fixed to tunnel 11, rod 8 in its extended condition and smooth bearing 7 fulfill the function of a supporting frame to support propeller shaft 3 in rotation while under motor propulsion.

The overall housing comprising tunnel 11 and well 12 forms a watertight recess in the hull of the vessel and is made, during the construction of the same or subsequently, of the same material as or another material than said hull 1, provided that it is guaranteed to be leaktight in relation to the interior of the vessel. Optionally said tunnel 11 and/or said well 12 may be provided with adjustment openings for the purpose of maintenance provided with corresponding sealing doors accessible from the interior of the hull.

Piston 9 may be operated hydraulically by engine 2 or through any other appropriate drive means, for example, an electric pump or other independent power unit 19 (see FIG. 1).

Likewise said operating piston 9 may be replaced by an equivalent electrical, mechanical or manual operating system supplemented by guide slides or connecting rods (not shown).

Figure 4:
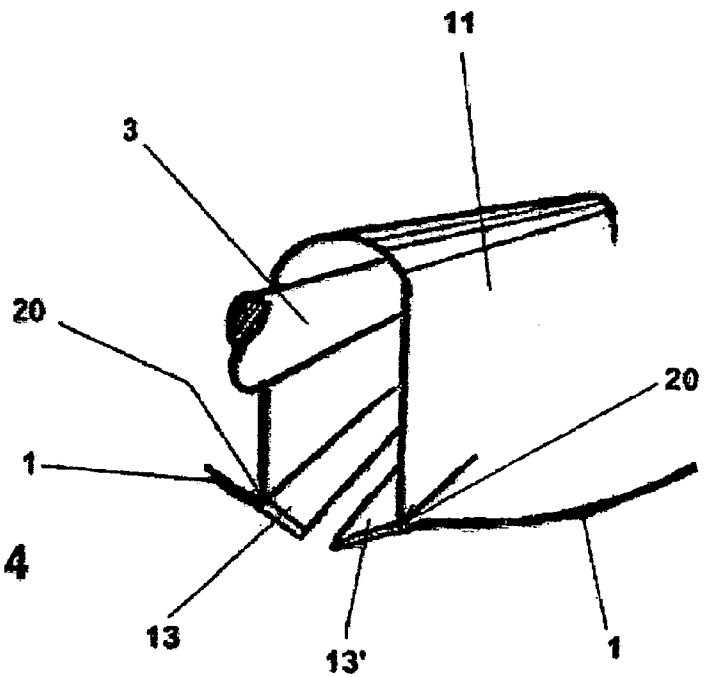
FIG. 4 is a diagram which shows a detail in perspective and in transverse cross-section along the line A—A in FIG. 2 of part of the hull of a vessel incorporating a first preferred embodiment of the system according to the invention.

Reference is now made to FIG. 4 in the drawings, which illustrates diagrammatically and in perspective a fragment of part of tunnel 11 in transverse cross-section along the line A—A in FIG. 2. Propeller shaft 3 housed in the said tunnel 11 in the condition in which the propulsion system is not in use and the arrangement of sealing doors 13, 13' manufactured from appropriate elastic materials or hinged at points 20 spaced along the edge of the junction with hull 1 in such a way that they can swing back and forth inwardly and outwardly with respect to the said hull to permit passage of the propulsion assembly comprising shaft 3 and propeller 4 in its movements entering and exiting from said hull 1 may be seen in this figure.

In their closed condition, said doors 13, 13' define a watertight space comprising tunnel 11 and well 12 so that in the condition in which the engine is not in use the hydrodynamic profile of hull 1 is without any appendages belonging to the said propulsion system giving rise to resistance to sailing.

Said doors 13, 13' may be provided for example with preloaded springs designed to hold them in the closed condition (not shown), the retaining force of which is overcome by the thrust of shaft 3 and propeller 4 as the propulsion system is extended from tunnel 11 and well 12, and when the same is retracted within the hull. In both cases the doors will yield, moving back and forth to permit the passage of shaft 3 and propeller 4 between their two extreme positions.

Figure 5:
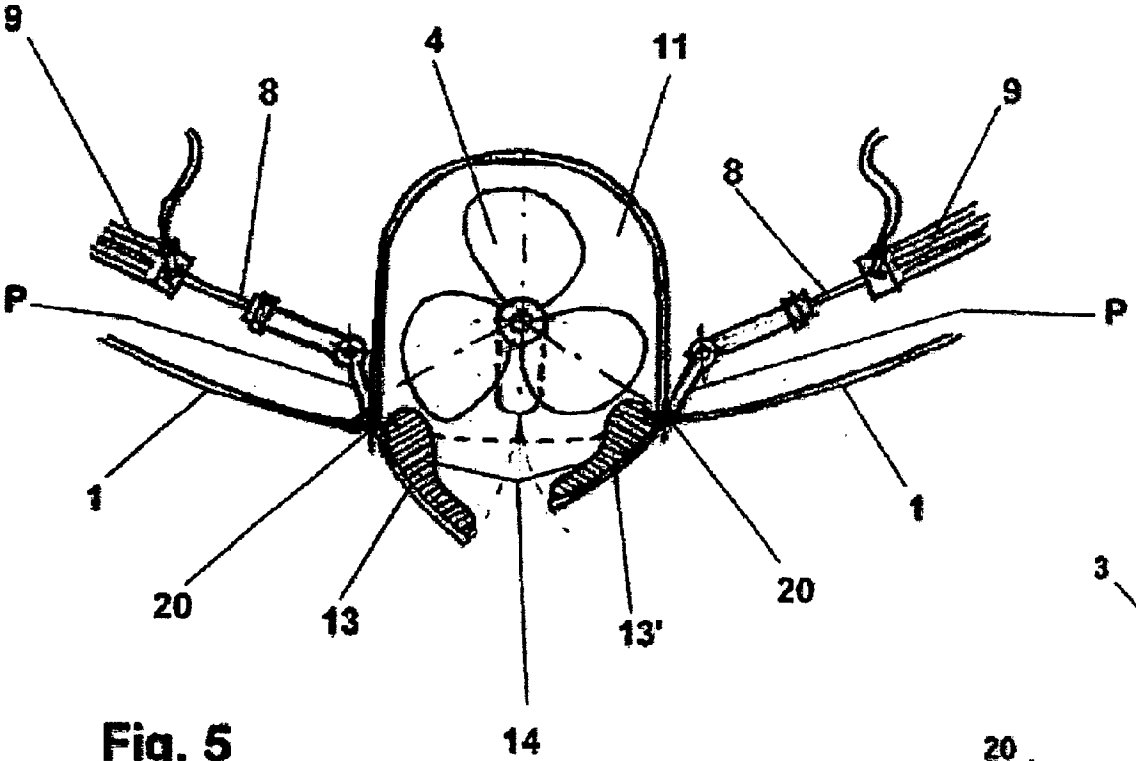
FIG. 5 is a transverse cross-section of the hull of the vessel in FIG. 1 showing an alternative embodiment of the system according to the invention.

In a preferred embodiment said doors 13, 13' may have masses 14 of appropriately shaped lightweight material on their inner surfaces in such a way that when in the closed condition and with the tilting propulsion system housed within the tunnel the free space which can be filled with water is the minimum desirable (see FIG. 5).

In said FIG. 5 an alternative manner of operating said doors 13, 13' between their closed and open positions may also be seen. In this case each door is activated in order to open or close it by an independent operating mechanism similar for example to piston 9 described above, the rod 8 of which acts on a lever P operating the door hinged to hull 1 at 20.

Figure 6:
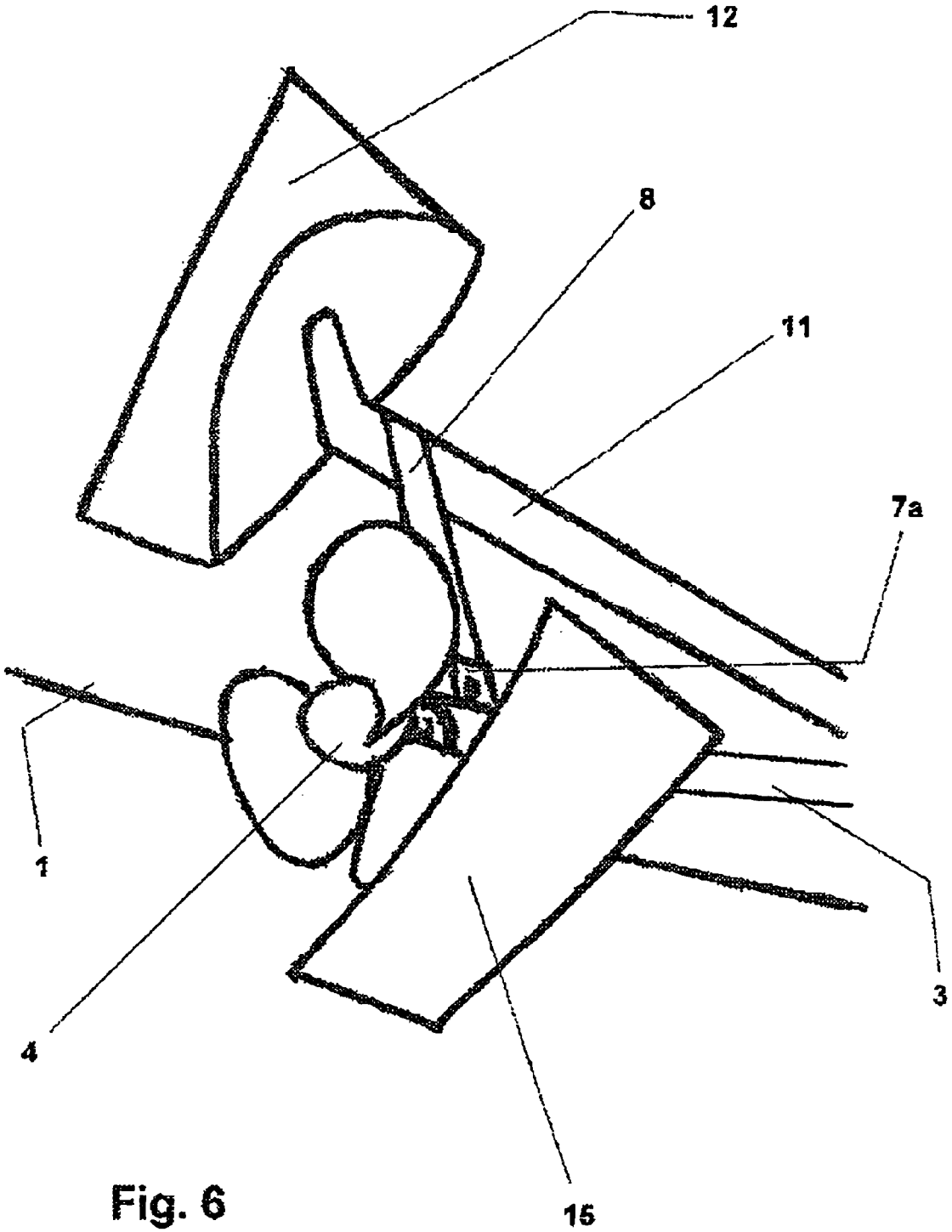
FIGS. 6 and 7 illustrate additional alternative embodiments of the propulsion system according to the invention.

In another alternative embodiment (see FIG. 6), the leaktight seal for well 12 designed to house propeller 4 may be achieved through a fairing 15 which is of one piece with the supporting frame, for example, secured to the bottom part of the smooth bearing and designed to press in a sealing relationship against the edges of the opening of said well 12 when shaft 3 and therefore propeller 4 rise towards their housing in the interior of the hull.

Figure 7:
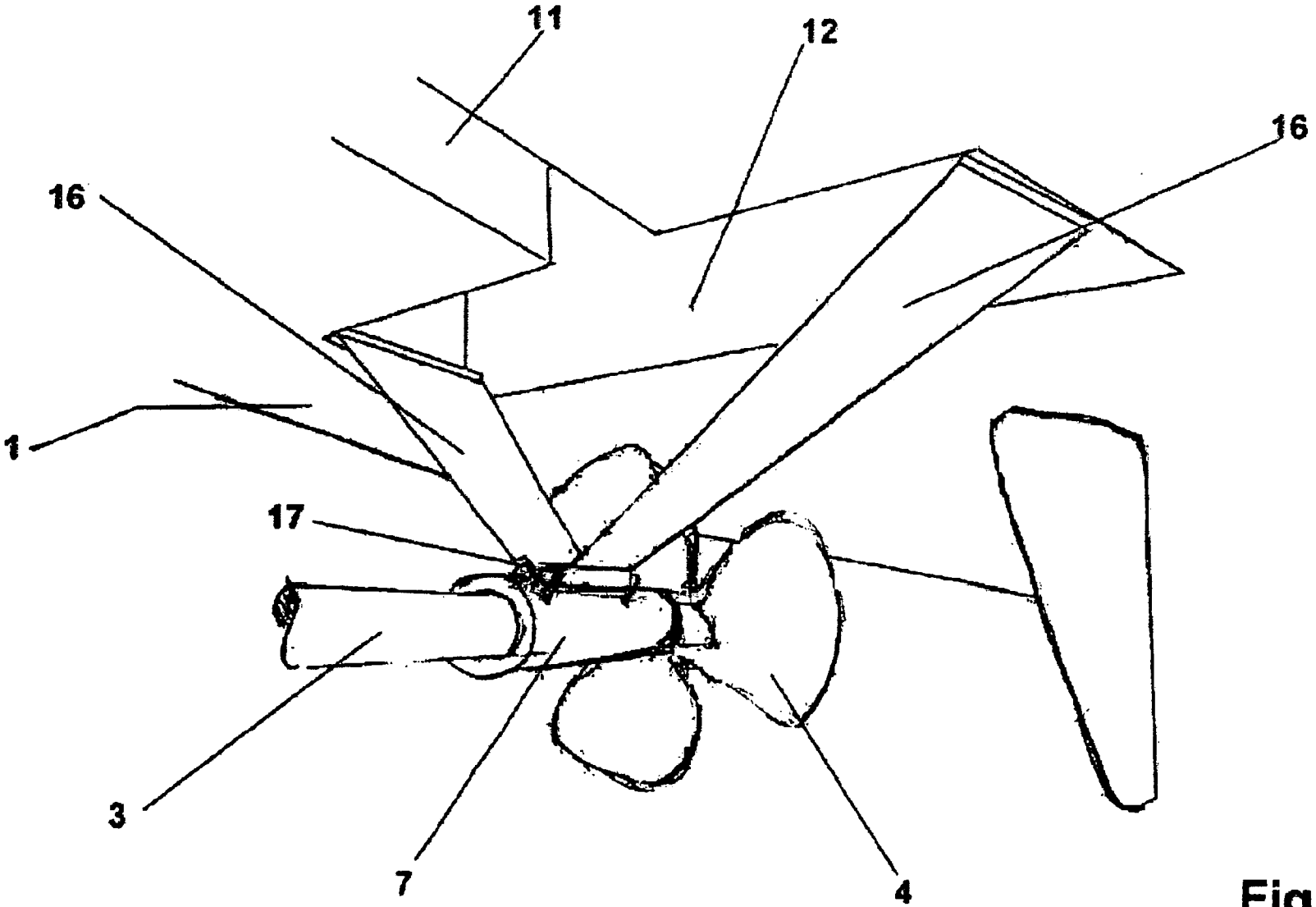

Finally, FIG. 7 shows another alternative embodiment in which smooth bearing 7 is mounted on two supporting frames 16 hinged thereto at their lower ends at 17 and operated so as to retract into tunnel 11 and well 12 and extend therefrom. These two frames 16 may be replaced by individual operating pistons similar to piston 10 in the embodiments previously described. This arrangement is useful when the power transmitted to the propeller shaft requires it.

The retractable propulsion system according to the invention is supplemented by various safety measures such as electronic microswitches (not shown) intended to make it impossible to bring about retraction of the propulsion system if the operating (forward-astern) control of the propulsion system is not in the off position or, conversely, that is to say the said control cannot be operated in any way forward or astern unless the propulsion system is in its extended position and is secured therein. Otherwise it would be possible to sail under sail with the propulsion system retracted in the hull and with the engine in operation.

It is also possible to provide sealing means between doors 13, 13', 15 and hull 1 so as to form a sealed enclosure for housing the propulsion system within said hull 1, with the possibility of expelling the water lying within it once the doors have been closed, through a bilge pump for example.

In what follows reference will be made to FIGS. 8*a*, 8*b*, 9*a*–9*d* and 10 to explain the construction and operation of the currently preferred embodiment of the actuating, guidance and locking device for the retractable system according to this invention.

Figure 8A:
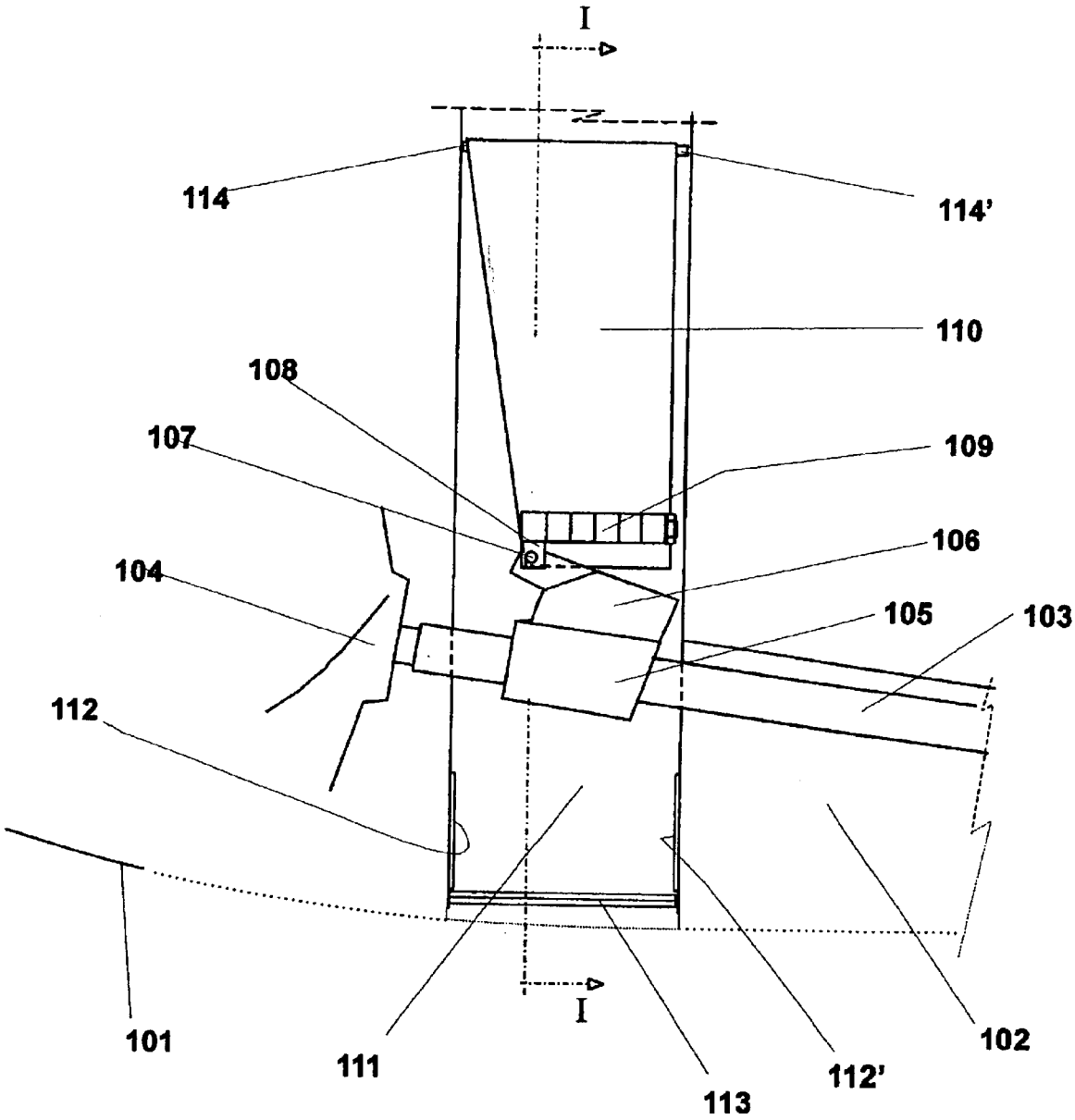
FIG. 8*a* is a diagrammatical side view of a preferred embodiment of the guide and locking device according to the invention, in the retracted condition, incorporated in a retractable propulsion system for a vessel.
Figure 8B:
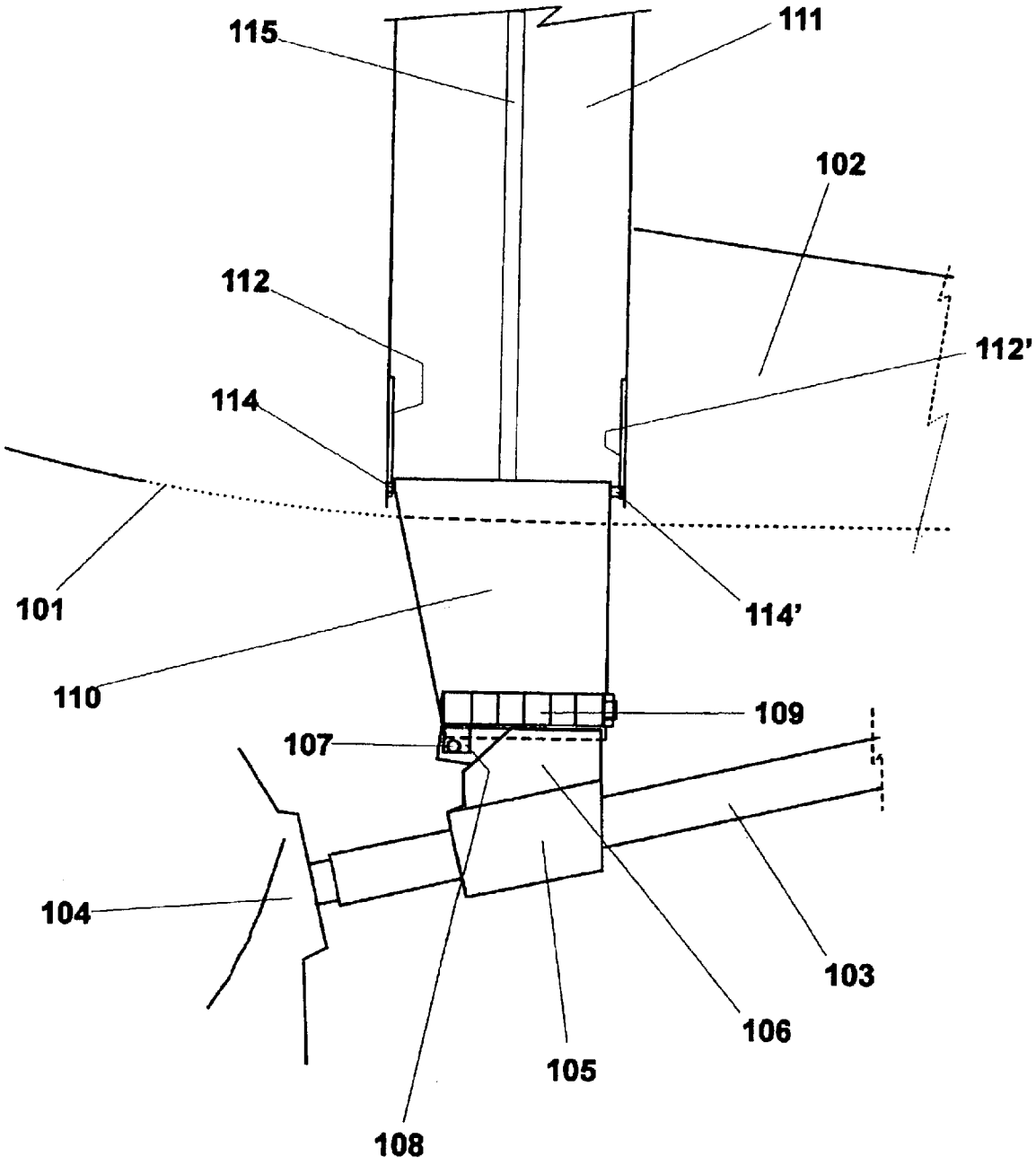
FIG. 8*b* is a diagrammatical view similar to that in FIG. 8*a* but in which the said arrangement is in its extended operating condition.

With reference now to the drawings and in particular FIGS. 8*a* and 8*b* thereof, 101 indicates the hull of a vessel provided with a propulsion system comprising an engine (not shown) which drives a shaft 103 of a propeller 104. In the condition illustrated in FIG. 8*a* said shaft 103 is housed within a tunnel 102 provided in the bottom of said hull 101, while propeller 104 is housed in an enlargement located at the after end of said tunnel 102, also within the said hull.

Propeller shaft 103 is supported in rotation by a supporting bearing 105 which in turn can slip along said shaft 103 when the latter tilts between its positions shown in FIGS. 8*a* and 8*b*.

Supporting bearing 105 has an eye lug 106 which projects radially therefrom in a vertical direction. At the after end of this eye lug 106 there is an opening to receive a pin 107 acting as a pivot which also passes through two side pieces 108, 108' (of which only one, 108, is illustrated in FIGS. 8*a* and 8*b*) which are of one piece with hinge 109 and also comprise the two members 110, 110' forming the V-shaped supporting frame according to the invention. Said side pieces 108, 108' straddle the said extreme after end of aforesaid eye lug 106.

All this assembly is housed in a cavity 111 provided within hull 101 and both tunnel 102 and said cavity 111 and the enlargement of said tunnel 102 intended to receive propeller 104, which open in the base of the hull, are sealed in the condition in which the propulsion mechanism is retracted, illustrated in FIG. 8*a*, by corresponding sealing doors similar to those described above in relation to FIGS. 4 and 5 which are intended to provide a continuous surface for said hull 101 in the retracted condition.

As previously mentioned, shaft 103 includes at least in its forward end, closer to the engine, a universal joint or, alternatively, a homokinetic joint (see FIGS. 1 to 3) which allows it to tilt between the positions illustrated in FIGS. 8*a* and 8*b*.

On the inside of the walls of the forward side and the after side of said housing 111 provision is made for guides 112, 112' respectively, the two guides in each pair being substantially arranged in an inverted V-shape, the arrangement of which will be seen more clearly in FIGS. 9*a*–9*d*, the purpose of which will be described below.

Finally, on the port and starboard sides of the rectangular opening defined by housing 111 in the bottom of hull 101, and very close to the edge of the said opening, provision is made for individual locking blocks 113, 113' integral with hull 101 of the vessel whose opposing surfaces match the interior of the hull, having engaging grooves 123, 123' of V-shaped cross-section whose purpose will be explained in what follows when the operation of the system in accordance with the invention is described with reference to FIGS. 9*a*–9*d*.

Finally, as may be better seen in FIG. 8*a*, in which only one (110) of the components of the V-shaped frame is shown, the upper end of each of the said members 110, 110' has a pair of short robust guide tenons 114, 114' which are intended to act together with said guides 112, 112' respectively as will be seen below.

The assembly of members 110, 110' of the supporting frame, supporting bearing 105, shaft 103 and propeller 104 is lowered from the position illustrated in FIG. 8*a* to the extended operating position illustrated in FIG. 8*b* through the operation of actuating means provided within hull 101, outside said housing 111, and which in this case are illustrated by means of rod 115 (see FIG. 8*b*) which for example may belong to an operating piston (not shown) but which may alternatively comprise any other suitable mechanism such as detailed in the said Spanish patent application identified above.

In what follows, and with reference in particular to FIGS. 9*a*–9*d* in the drawings, the remainder of the guide and immobilization system for this invention will be described in detail in relation to its manner of operation.

Figures 9A, 9B:
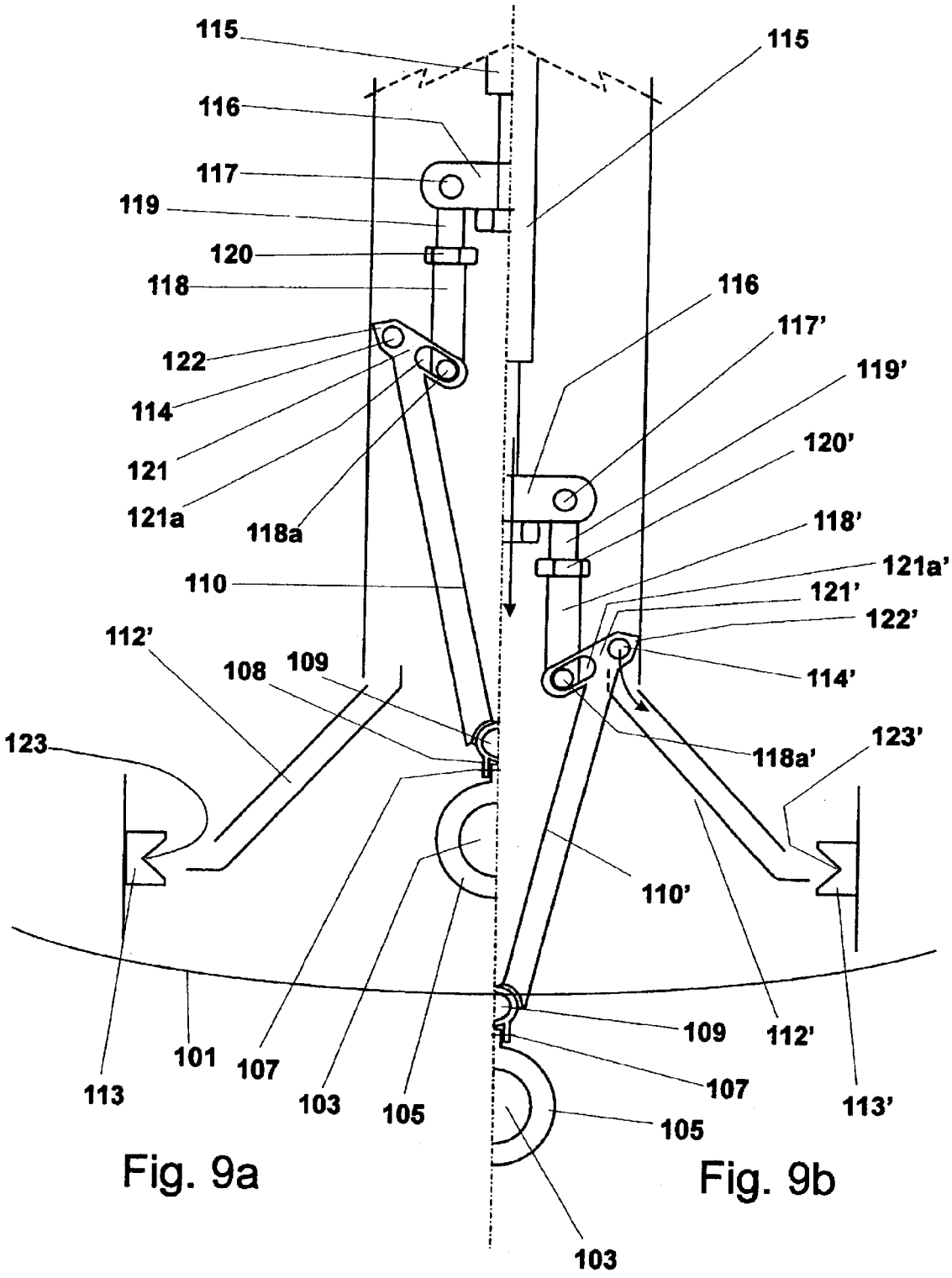
FIGS. 9*a* and 9*d* illustrate different positions adopted by the actuator, guide and locking device according to this invention when in operation, diagrammatically and in views taken from the stern along the cross-section line I—I in FIG. 8*a*.

Thus FIG. 9*a* illustrates the port half of the mechanism according to the invention in its retracted condition, corresponding to the condition illustrated in FIG. 8*a*, and in which all the components forming part of retractable propulsion system 1 of the vessel lie within hull 101.

For its part FIG. 9*b* shows the actuating, guidance and locking arrangement according to the invention in an intermediate position during its descent, in which position shaft 103 of propeller 104 (not shown in these figures) has begun to descend below the bottom of hull 101 and the articulated parallelogram mechanism which will be described below is at the point at which it begins to unfold through cooperation between tenons 114, 114' and upside-down V guides 112, 112', of which only those designated by 112' are shown in these figures since those indicated by 112 are located outside the plane of the drawing in the direction of the reader.

Figures 9C, 9D:
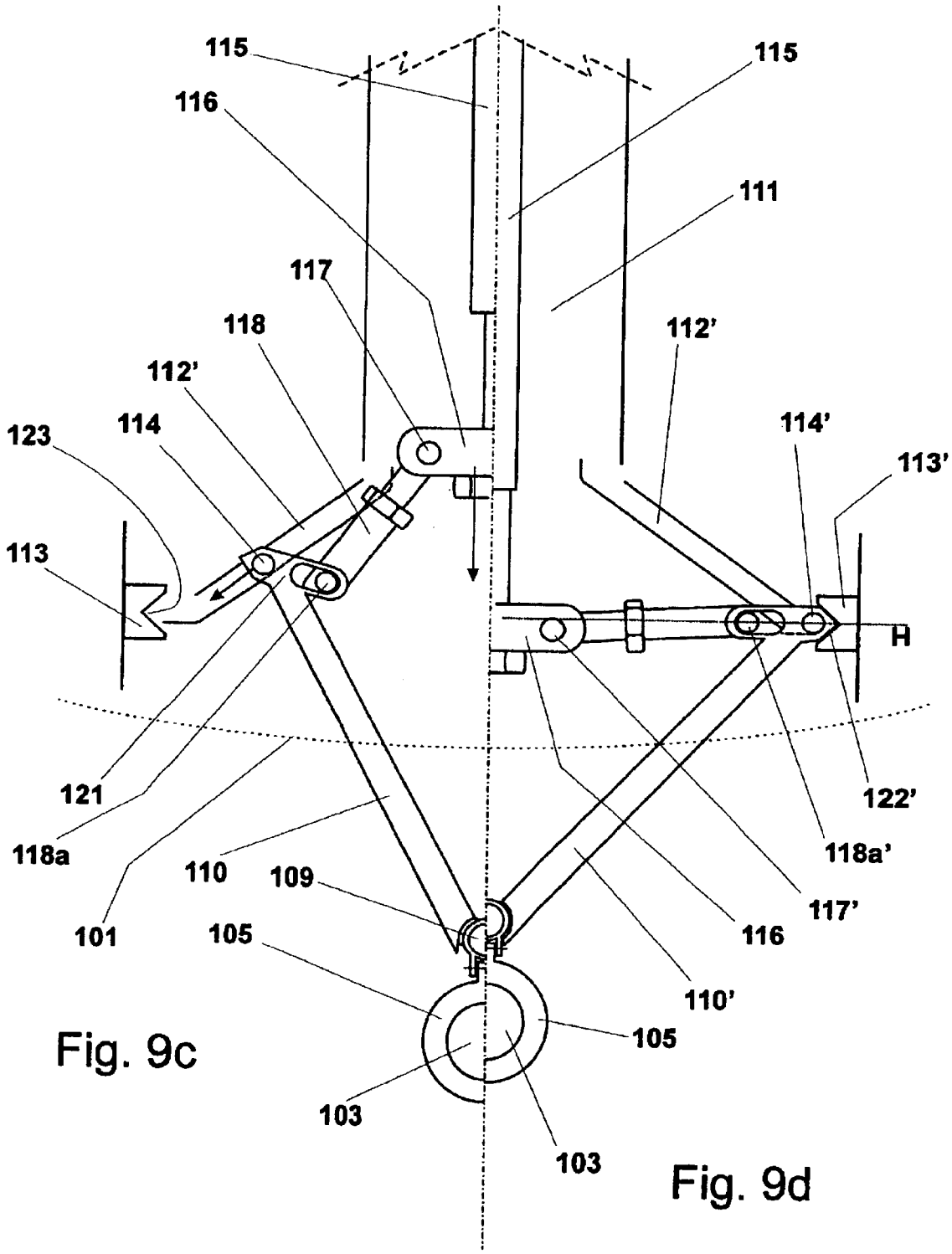

As for FIG. 9*c*, this is an illustration of the said articulated parallelogram in its condition of guided descent to the final locked extended position shown in FIG. 9*d*. This illustration in FIG. 9*d* in turn corresponds to the condition shown in FIG. 8*b* in which all the equipment constituting the retractable propulsion mechanism for the vessel is in the operating position.

With reference now in particular to FIG. 9*a* of the drawings, in which it will be seen that rod 115 of the actuating mechanism is located in its retracted position and that at its lower end there is attached on one side a horizontal coupling piece 116, the other side of which has pivotably mounted upon it, along axis 117, 117', arms 118, 118' of a length which can be adjusted thanks to the corresponding threaded rod 119, 119' and nut 120, 20' assemblies respectively, the arms of which have pairs of studs 118*a*, 118*a*' at their lower ends which are designed to be inserted into corresponding grooves 121*a*, 121*a*' made in the heads 121, 121' of frame members 110, 110', the heads of which have a lateral edge 122, 122' in the shape of a wedge. In this way rods 118*a*, 118*a*' can rotate and move in grooves 121*a*, 121*a*' when operating mechanism 115 performs its lowering and raising movements to extend and retract respectively the system of articulated arms according to the invention in a way which is explained below.

Said frame members 110, 110' are hinged in their lower part at 109 (see also FIGS. 8*a* and 8*b*) in a hinged joint which at its after end has two side members 108, 108' pointing downwards to define a fork which receives after side member 106 of bearing 105 supporting the shaft 103 of the vessel's propeller rotatably about an axis 107. As will be seen in FIGS. 8*a* and 8*b*, this articulation between side pieces 108, 108' and the after end of eye lug 106 about axis 107 allows the upper longitudinal edge of said side piece 106 to follow the movement of hinge 109 in a vertical direction as the latter is raised and lowered through the effect of the action of rod 115 without interfering therewith in such a way that in the retracted positions illustrated in FIG. 8*a* the said upper longitudinal edge of side piece 106 forms an acute angle with the lower part of said hinge 109, while when the mechanism is in its extended condition (see FIG. 8*b*) the said upper longitudinal edge and the lower part of the said hinge are pressed together over their entire length.

In this retracted condition (FIGS. 8*a* and 9*a*) of the mechanism, the set of articulated arms 110, 110', 118, 118' defining an articulated parallelogram are in a folded position within housing 111.

As mentioned previously, this retracted condition is that used when the vessel is under sail or has problems relating to its draught which make it desirable to retract the propulsion system in order to avoid snagging submerged or similar objects, for example.

When it is desired to use the propulsion system through propeller 104, the extension mechanism of rod 115 is activated and this, see FIG. 9*b*, begins its descent in the direction of the arrow and pushes against arms 118, 118' and members 110, 110' of the supporting frame, causing the entire mechanism to descend outside hull 101. In the case where the abovementioned sealing doors for tunnel 102, housing 111 and the enlargement receiving propeller 104 are activated mechanically, these are already in the open position (not shown). If the doors are of the elastic type or are mounted elastically, the downward movement of the propulsion mechanism itself will move them so that they separate and allow the said mechanism to exit into its operating position.

In FIG. 9*b* it will be seen that the descent of rod 115 has brought guide tenons 114, 114' into the vicinity of the upper entrance end of the guides 112, 112' located in an inverted V-shaped configuration in the after and forward walls respectively of housing 111 (see also FIGS. 8*a* and 8*b*), from which point as illustrated by the curved arrow guide tenons 114, 114' enter said guides 112, 112' and as descent of the aforesaid rod 115 continues begin to move (see FIG. 9*c*) which causes heads 121, 121' to move away from the central longitudinal plane of the vessel as a result of rotation and movement of heads 121, 121' of frame members 110, 110' around said rods 118*a*, 118*a*' of said heads 121, 121'.

FIG. 9*d* shows the final locked position of the articulated system according to the invention. In this it will be seen that the wedge-shaped ends 122, 122' of heads 121, 121' bear against grooves 123, 123' of locking blocks 113, 113' which are of one piece with hull 101. The over-centring effect which causes the continued descent of rod 115 once arms 118, 118', 119, 119' of the articulated parallelogram have reached a horizontal position will be seen in this figure, and as a result of this the said arms "spring" into the final locking position illustrated in said FIG. 9*d*, in which it will be seen that coupling piece 116 lies below the horizontal plane represented by the line H and defined by the apices of grooves 123, 123'. Only operation of operating rod 115 in an upward direction will cause the system of articulated arms according to the invention to abandon this locked position.

In addition to this locking of the V-shaped frame members which has the result that the hull of the vessel directly absorbs the forces generated by the rotation of the screw in the water, it will be seen in the sequence/of figures mentioned that the lower ends of members 110, 110' bear in the condition thereof illustrated in FIG. 9*d* against the side piece 106 of supporting bearing 105 and hold it fixed in that position exerting pressure on both sides thereof which helps to effect final rigid union of the members supporting the retractable system according to the invention.

In this extended operating condition the system according to the invention provides a support for the propulsion mechanism for the vessel which overcomes all the disadvantages of the prior art in that it offers a robust and play-free support for the retractable propulsion system.

With regard to retraction of the propulsion system from its operating position illustrated in FIG. 9*d*, it is obvious that it is sufficient to reverse the direction of movement of operating rod 115, retracting it within hull 101, for arms 118, 118', 119, 119' to overcome their over-centring position and for the system to begin to fold up again following a sequence which is the reverse of that just described, passing from the operating position extended outside the hull illustrated in FIGS. 8*b* and 9*d* to reach the folded position illustrated in FIGS. 8*a* and 9*a*, in which shaft 103 and V-shaped frame members 110, 110' and propeller 104 are housed within the hull and no appendage breaks the surface of the latter as described in the abovementioned Spanish patent application.

As a person skilled in the art will be aware, the arrangement according to the invention provides, as mentioned above, for the actuation, guidance and locking of the assembly comprising the propeller shaft, the supporting frame and the propeller itself which makes it possible to achieve improved performance of the said assembly in comparison with the prior art. Nevertheless, the invention is not restricted to this preferred embodiment which has just been described by way of illustration, and it is possible to introduce many changes therein without thereby going beyond the spirit of the invention.

Figure 10:
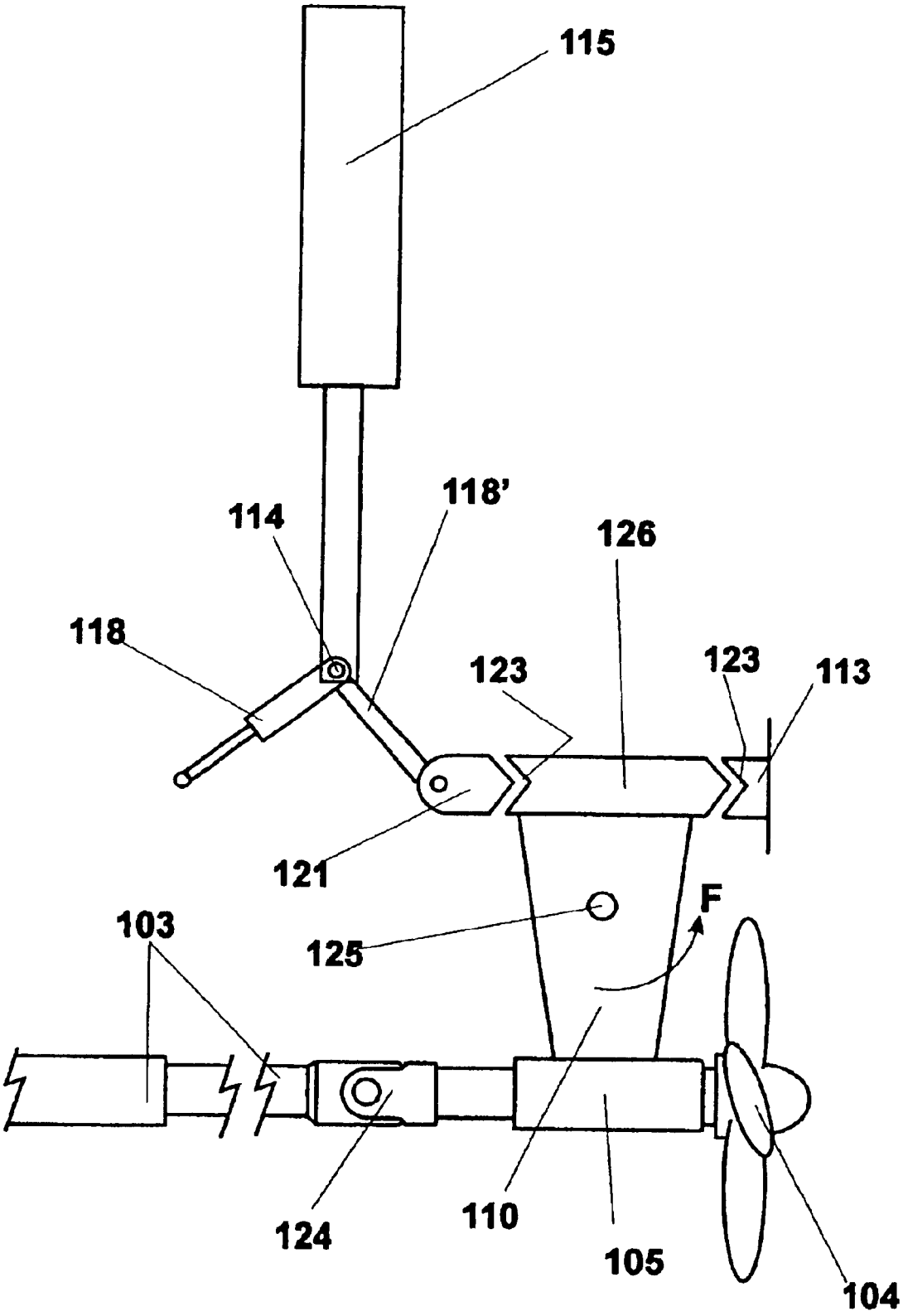
FIG. 10 shows diagrammatically a second embodiment of the arrangement according to the invention.

In fact FIG. 10 diagrammatically illustrates an alternative embodiment of the arrangement according to the invention. In said FIG. 10 elements similar to those illustrated and described in relation to the embodiment in FIGS. 8*a–b* and 9*a–d* have the same numbers as in those figures.

Thus it will be seen that propeller shaft 103, which in this case is a telescopic shaft, is provided with an additional universal joint 124, positioned very close to propeller 104, supporting bearing 105 being located between this universal joint 124 and said propeller 104, as may be seen in said FIG. 10. However, in this embodiment frame member 110 is joined in a fixed manner by its lower end to said bearing 105 and has at its upper end a head 126 having the configuration shown in the drawing. It should be mentioned at this point that said frame member 110, which in this case has the shape of an inverted isosceles triangle (although this cannot be seen in the drawing), is essentially located in a plane perpendicular to propeller shaft 103, with bearing 105 fixed at its lower apex, said head 126 forming its upper base.

Frame member 110 is mounted so as to pivot about an axis 125 so that it can tilt between the position illustrated in said FIG. 10 and a horizontal position (not shown) on being caused to do this by actuation means which are not shown.

Said FIG. 10 also illustrates locking means of the type of those comprised in the preferred embodiment mentioned above, in this case comprising arms 118, 118' set at an angle, hinged together at 114 and connected at the said hinge point to activation means 115 which fulfil the same function as the activation means in the preferred embodiment described above. At the free end of said arm 118' there is provided a head 121 with a wedge-shaped edge which is designed to engage in the throat 123 of said head 126 of the supporting frame, bearing against the latter to produce a condition in which it is coupled with locking piece 113 which is of one piece with the hull of the vessel.

In this embodiment the system of locking by over-centring is achieved in the condition of the propulsion system illustrated in FIG. 10 through actuation of actuation means 115 which in bringing about downward displacement of hinge point 114 cause the compass formed by arms 118, 118' to open, causing said wedge 121 to press against groove 123 of said head 126 and to be displaced causing its wedge-shaped edge to bear on corresponding throat 123 of locking piece 113. The propulsion system is firmly secured in its operating position in this way.

When actuating means 115, which on rising draw hinge 114 upwards, thereby closing the angle between said arms 118, 118', are retracted, wedge 121 separates from head 126 and allows the latter to be in turn separated from locking piece 113. For this the means (not shown) which cause supporting frame 110 to tilt about axis 125 are activated, with the result that the supporting frame moves in the direction indicated by arrow F, lifting propeller 104 upwards as a result of extension of telescopic arm 103 until it reaches a substantially horizontal position in which both supporting frame 110 and bearing 105 positioned in a vertical direction and propeller 104 abutting in approximately a horizontal plane are all housed within the hull of the vessel.

Through this embodiment the space occupied by the members of the propulsion assembly within the interior of the hull is significantly reduced.

The retractable propulsion system according to this invention described above can because of its simplicity be incorporated in newly built hulls or in vessels which are already in use.

The invention also allows for the possibility that the upper part of the housing intended to house the propeller be located above the waterline, as a result of which it can be accessed for the purpose of maintening and repairing the propeller without the need to take the vessel out of the water or to use other costly means such as divers, etc., for example.

Finally, as a person skilled in the art will easily imagine, this new propulsion system can also be applied to any type of vessel which is propelled solely by mechanical means where it is necessary or desirable to stow away or protect the said propulsion members in particular circumstances.

What is claimed is:

1. Actuating, guiding and enclosing device for a retractable system for stowing away propulsion components for a vessel of the type comprising:

a hull (1; 101) provided with an enlarged longitudinal housing (2, 11; 102) to receive in a retracted condition the propulsion assembly (3, 4; 103, 104) of the vessel in such a way that the said housing (2, 11; 102) can be enclosed by means such that in the closed condition they form a surface without any break in the continuity of the said hull (1; 101), characterized by an articulated assembly comprising at least a first pair of upper arms (118, 118') and a second pair of lower arms (110, 110') articulated together in such a way as to form an articulated parallelogram (118, 118'; 30 110, 110'), this assembly being capable of moving in a vertical direction from an upper position retracted within the said hull (1; 101) in which the said articulated parallelogram is in the folded condition and a lower extended position in which the said articulated parallelogram (118, 118'; 110, 110') is in a deployed condition substantially outside the said hull (1; 101), the upper articulation (116) of the said articulated parallelogram being connected to the lower end of actuating means (9; 115) which can be moved vertically and connected at its lower articulation (109) to the bearing (7; 105) supporting the shaft (3; 103) of the propeller (4; 104) through a coupling (107, 108) which tilts in the longitudinal plane of the vessel and of one piece with the said supporting bearing (7; 105), guide means (112, 112') substantially in the shape of an upside-down V provided in the forward and after walls of the said part (111) of the said leaktight housing (11; 102) designed to receive and guide tenons (114, 114') which project longitudinally from the wedge-shaped members (121, 121') incorporated in the lateral articulations of the said articulated parallelogram to guide the said tenons (114, 114') during part of the descending course of the said assembly of the articulated arms (118, 118'; 110, 110') in order to cause progressive opening of the said articulated parallelogram as the said actuating means (9; 115) descend, securing means comprising the aforesaid lateral articulation members (121, 121')each cooperating with locking members (113, 113') provided with grooves (123, 123') having a shape matching that of the said wedge shaped members (121, 121') and of one piece with the sides of the said hull (1; 101), and immobilizing means comprising the said upper arms (118, 118') which with the continued descent of the said actuating means (9; 115) take up an over-centred position while the said members (121, 121') provided with wedge-shaped edges (122, 122') are caused to bear tightly against the said grooves (123, 123') of the said enclosure members (11 3, 113'), the said lower arms (110, 110') then acting as a supporting frame for the propulsion assembly of the vessel and immobilizing it in an operating position.

2. Device according to claim 1, characterized in that the lengths of the said upper articulated arms (118, 118') are adjustable.

3. Device according to claim 1, characterised in that the change from the folded condition of the said device to the deployed condition takes place keeping the said articulated arms (118, 118', 110, 110') substantially in a vertical plane transverse to the vessel.

4. Device according to claim 1, characterised in that the articulated assembly comprises only one pair of upper arms (118, 118') and in that the supporting frame (8, 16; 110) comprises a triangular member which is of one piece with the bearing (7; 105) supporting the shaft (3; 103) of the said propeller (4; 104), the said supporting frame (8, 16; 110) being mounted in such a way that it can be caused to rotate by the actuating means about a horizontal axis (125) transverse to the said hull (1; 101) between a condition substantially outside the same and in that the change from the folded condition of the articulated assembly to the deployed condition takes place in a plane which is substantially longitudinal to the vessel in a manner which is synchronized with the change in the said supporting frame from its retracted condition to its extended condition in order to lock it to the latter in the operating condition of the said device.

* * * * *